US010441038B2

(12) United States Patent
Surber

(10) Patent No.: US 10,441,038 B2
(45) Date of Patent: Oct. 15, 2019

(54) PROCESS FOR PRODUCING DECORATED MEDALLIONS AND METALS

(71) Applicant: Jerry Surber, Madisonville, TX (US)

(72) Inventor: Jerry Surber, Madisonville, TX (US)

( * ) Notice: Subject to any disclaimer, the term of this patent is extended or adjusted under 35 U.S.C. 154(b) by 0 days.

(21) Appl. No.: 15/401,560

(22) Filed: Jan. 9, 2017

(65) Prior Publication Data

US 2017/0280835 A1 Oct. 5, 2017

Related U.S. Application Data

(60) Provisional application No. 62/315,147, filed on Mar. 30, 2016.

(51) Int. Cl.

| | |
|---|---|
| ***A47G 35/00*** | (2006.01) |
| ***A44C 3/00*** | (2006.01) |
| ***B41M 5/00*** | (2006.01) |
| ***A44C 27/00*** | (2006.01) |
| *B41J 3/407* | (2006.01) |

(52) U.S. Cl.

CPC ..... *A44C 3/005* (2013.01); *A44C 27/002* (2013.01); *B41M 5/0058* (2013.01); *B41M 5/0088* (2013.01); *B41J 3/4073* (2013.01)

(58) Field of Classification Search

None

See application file for complete search history.

(56) References Cited

U.S. PATENT DOCUMENTS

2005/0103182 A1* 5/2005 Spurgeon ..... B41J 3/407 84/291
2007/0207333 A1* 9/2007 Surber ..... A47G 33/004 428/542.4
2010/0013880 A1* 1/2010 Polk ..... B41J 3/4073 347/9
2017/0218520 A1* 8/2017 De Mondt ..... C09D 11/101

FOREIGN PATENT DOCUMENTS

DE 19814909 A1 * 10/1999 ..... A44C 3/004

OTHER PUBLICATIONS

Kurtz Alex, Machine translation of DE 19814909 Abstract, Description and Claims, Oct. 14, 1999 (Year: 1999).*
De-Rusting, Degreasing and Cleaning Pretreatment, Jan. 25, 2009, Vanchem performance chemicals (Year: 2009).*
UV Flatbed Printing, Sep. 25, 2015 (Year: 2015).*

* cited by examiner

*Primary Examiner* — David Sample
*Assistant Examiner* — Mary I Omori
(74) *Attorney, Agent, or Firm* — Douglas Baldwin

(57) ABSTRACT

A process for customization of decoration that allows efficient production of small batches of custom awards medallions, medals and coins, particularly suitable for die cast medal medallions, medals and coins. The invention is also the medallions, medals and coins made by the process.

9 Claims, 2 Drawing Sheets

PROCESS FOR PRODUCING DECORATED MEDALLIONS AND METALS

CROSS REFERENCE TO RELATED APPLICATIONS

This application claims benefit of Provisional Patent Application Ser. No. 62/151,147 filed Mar. 30, 2016, the contents and disclosure of which is incorporated herein by reference in its entirety for all purposes.

BACKGROUND

Field of the Invention

The invention pertains to the manufacture and decoration of di-cast medallions, medals and coins.

Background

Medal or medal like medallions, "medals" and coins are widely used for recognition of achievement or participation in athletic events and other contests. It is desirable that the medallions and medals be customized to reflect the event or activity. Thus, there usually is a need for a relatively small number of customized medallion or medals of any specific design and decoration. Currently, most industry medallions are mass produced with some generic decoration—for example, designating a sport such as soccer, football, baseball, fencing, etc. Some are specially customized by attaching event specific or sport specific printed labels (such as on Mylar or medal such as aluminum) plates. This makes them more expensive and more troublesome to produce than desired. For suppliers to stock mass produced specific medallions and medals requires a huge and varied inventory because of the great variety of events and activities.

Flatbed printers are commonly used to print signs, banners and other large generally flat displays. However, a conventional flatbed printer can be adapted to apply ink to large numbers of small curved objects. See US 2012/0042794, published Feb. 23, 2012.

What is needed is an inexpensive easily customizable, means to provide medallions and medal that can be easily customized in small quantity by having decorations, graphics and information directly printed on blank (usually dye cast) medallion and medal blanks. The present invention is such a means.

BRIEF SUMMARY OF THE INVENTION

The invention is, therefore, process for customization of decoration that allows efficient production of small batches of custom awards medallions, medals and coins. It is particularly suitable for die cast medal medallions, medals and coins. The invention is also medallions, medals and coins made by the process.

DETAILED DESCRIPTION

In broad aspect the invention is a process for customization of decoration of medallions and medals that allow efficient production of small batches of custom medals and medallions and for just-on-time production. The process is particularity suitable for die-cast medallions and medals. The process eliminate a need for large inventory of individual medallions and allows just-in-time of sport and event specific products. Suppliers can inventory blanks and print specifics for custom orders.

Figure 1:
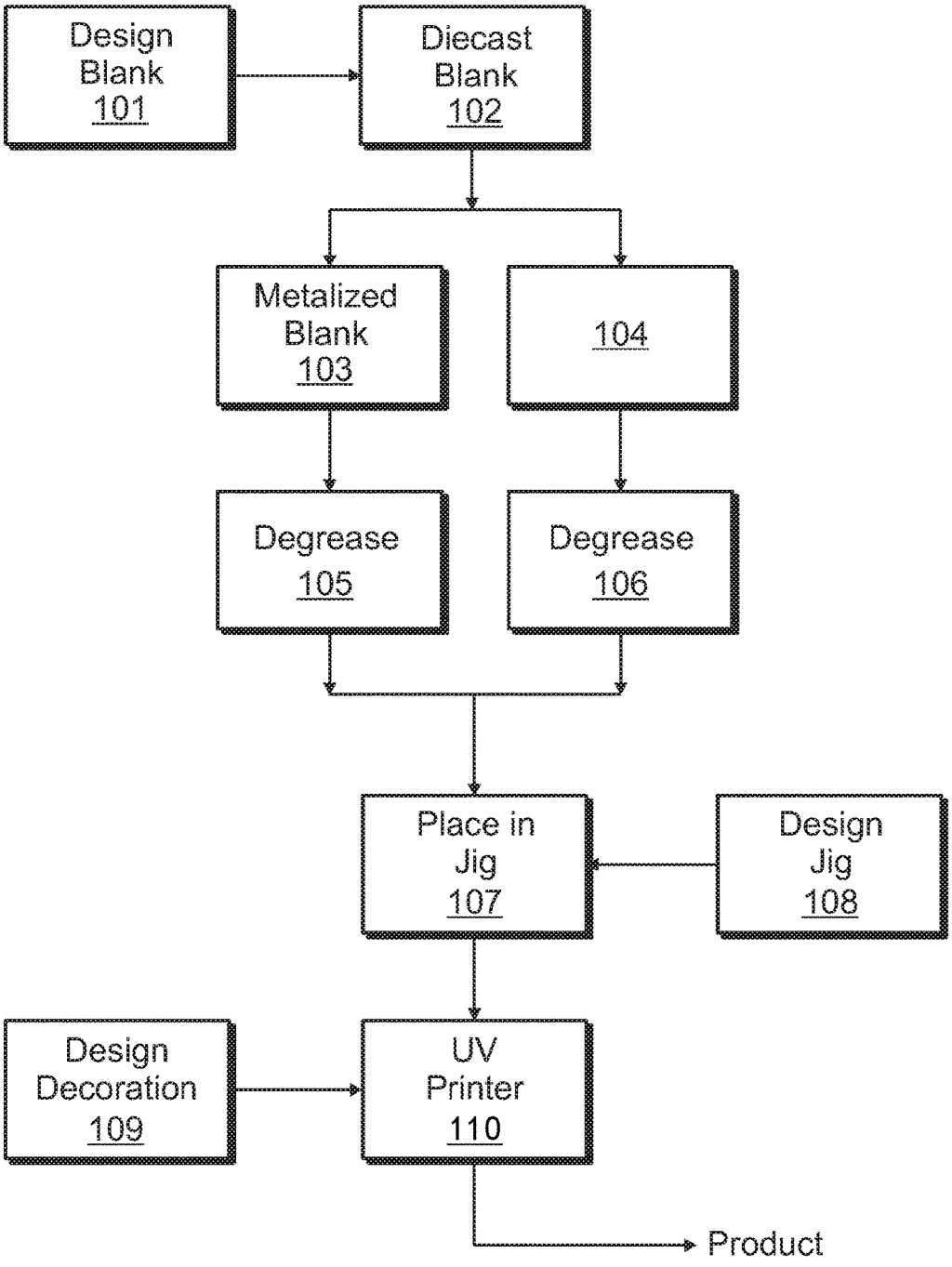
FIG. 1 is a process diagram of a process of an embodiment of the invention.

FIG. 1 is a process step chart of the process of an embodiment of the invention. The first step is the design of the medallion blank (101). A blank is a medallion (includes medals and coins) that has surface space on which can be printed designs and/or lettering. The blank is then die cast (102) from appropriate metal alloys (zinc alloys are most common). It is customary in the industry to obtain such medallions and medals from factories in China that require large batch production and large shipment orders. Thus, it is difficult to obtain small batch or "just-on-time" customization. Some larger medallions (generally more than two inches across) are customized by attaching printed stick-on label such as label printed on Mylar plastic or medal (such as aluminum) plaques. See published application US 2007/0207333, published Aug. 6, 2007, the disclosure of which is incorporated herein by reference.

"Die casting is a metal casting process that is characterized by forcing molten metal under high pressure into a mold cavity. The mold cavity is created using two hardened tool steel dies which have been machined into shape and work similarly to an injection mold during the process. Most die castings are made from non-ferrous metals, specifically zinc, copper, aluminum, magnesium, lead, pewter and tin based alloys. Depending on the type of metal being cast, a hot- or cold-chamber machine is used." "The casting equipment and dies represent large capital costs and this tends to limit the process to high volume production. Manufacture of parts using die casting is relatively simple, involving only four main steps, which keeps the incremental cost per item low. It is especially suited for a large quantity of small to medium-sized castings, which is why die casting produces more castings than any other casting process. Die castings are characterized by a very good surface finish (by casting standards) and dimensional consistency." Wikipedia; Die Casting.

Again referring to FIG. 1 the die-cast blanks may then be metallized, 103, (colored, usually in gold or silver) by electroplating or vacuum metalizing, to produce a suitable finish on the blank medallion. Alternatively the blank may be left without metalizing (104) and the background color (gold or silver generally) applied in the UV printing step (110) of the process of the invention. This provides a significant advantage by elimination of the separate metalizing step and allows addition efficient options for customizing. It is optional but preferred that the blanks be cleaned and degreased (105 or 106) before printing to ensure print integrity and consistency. Solvent degreasing is preferred. Solvent degreasing typically is accomplished with petroleum, chlorine, or alcohol based solvents to dissolve contaminants that might be on the blank medallion or medal.

The cleaned blanks are placed in a specially designed customized jig for printing. A jig is a structure that hold the medallions in place for printing and is placed on the flatbed printer for printing. The design of the jig (108) is made to allow the design of the decoration to be placed on the blank medallions properly. The decoration (109) and the placement in the jig (107) are designed to guide the operation of the UV flatbed printer in printing background decoration and designs and lettering on the blanks (110). Such design for flatbed printing is conventional and need not be detailed here. Thus, small quantities of customized medallions (medals and coins) can efficiently and economically easily be made.

Figure 2:
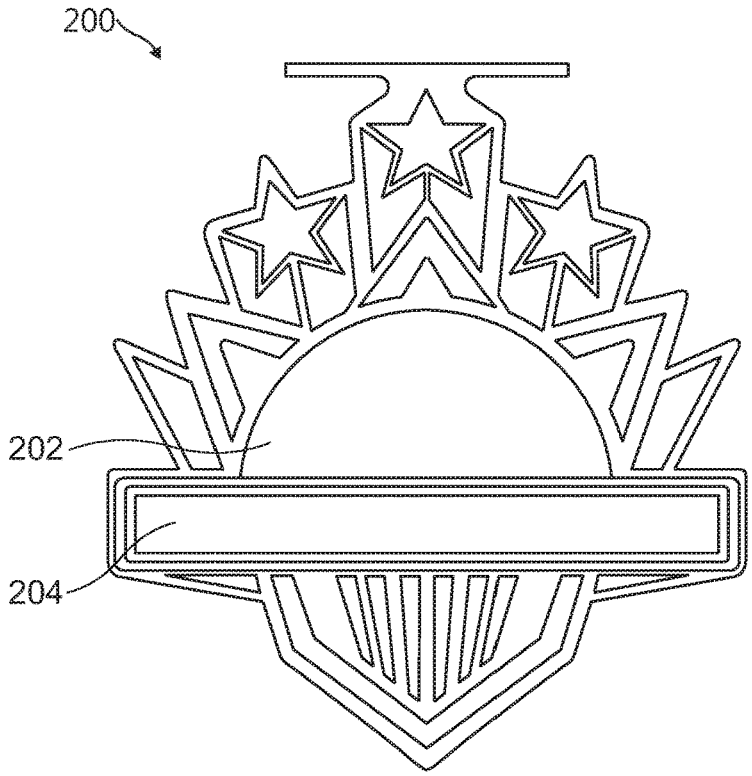
FIG. 2 is a front view of a blank medallion for use in an embodiment of the invention.
Figure 3:
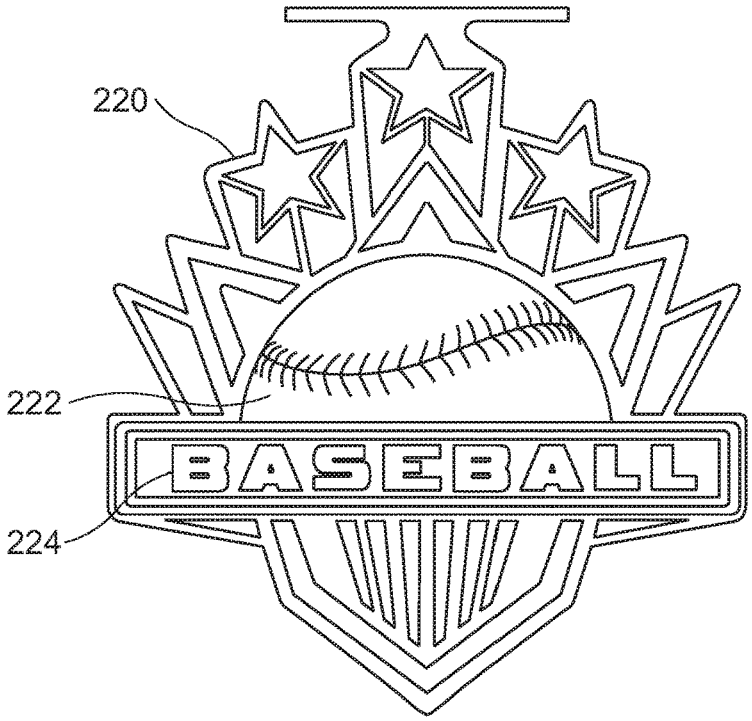
FIG. 3 is front view of a medallion after flatbed UV printing by an embodiment of the invention

FIG. 2 illustrates a typical blank medallion (200) that may be customized by the process of the invention. FIG. 3 shows the medallion after printing (220)—with "Baseball" printed in letters (224) and a picture of a baseball (222). The printing may be in any color combination and the lettering can designate the specific customer, event and sport. UV printing allows computer generated decorations, designs and lettering to be printed directly on the medallion and medal blanks (202, 204) thus making small number very economical. Flatbed printers are commonly used to print signs, banners and other large generally flat displays but for the application of the present invention the printers need be adapted to provide small dot size and use special UV ink. The ink needs to be very fast curing and have the ability to adhere to metallic surfaces. Such ink are commercially available. A prototype UV printer was used to print with 4 pico liter ink dots. The dot size is important in order to achieve clear and well defined images on the small medallions. Dot sized of about 1.5 to 8 pico liters are suitable depending on the definition of the images required. Variable dot printers are also very suitable to give very high resolution and definition to the graphic decorations. The printer customarily lays down a white base and then CMYK (cyan, magenta, yellow and black) colors printed on top of the base. Colors as those normally found in metallized medallions can also be added as a base coat before the other color printing. The process provides an all in one operation with multiple printing passes. Thus, infinite variation on color and decoration is possible.

As used herein medallion, medals and coins means structures used recognition for participation or achievement in an event and include tangible structures having at least one relatively flat surface suitable for printing. The term medallion is used herein and in the claims to mean both medallion, medals and coins.

As used herein "Flatbed UV Digital printing" is the reproduction of digital images using inkjet printing, typically on plastic or paperboard, although a wide variety of materials can be printed (common, photographic paper, film, cloth, plastic, etc.). Flatbed digital printers use inks made of acrylic monomers that are then exposed to strong UV-light to cure, or polymerize them Cure). Environmentally, flatbed UV digital printing is based on a more sustainable system than its commercial predecessor of solvent printing as it produces fewer waste cartridges and less indoor air pollution." See article in wikipedia at en.wikipedia.org/wiki/Flatbed_digital_printer. Use of flatbed printers for printing small objects (for example, fingernails) in a jig on a flatbed printed and the characteristic of suitable printers and operations is described in U.S. published application 2012/0042794, published Feb. 23, 2012, the disclosure of which is incorporated herein by reference.

In other embodiments the invention comprises medallions, medals and coins made by the process as described above.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

The invention claimed is:

1. A medallion, medal or coin that is decorated by a process comprising:

selecting a blank medallion, medal or coin having a space for decoration and/or lettering;

placing the blank medallion, medal or coin in a printer jig designed to contain the blank medallion, medal or coin in a fixed position while printing;

providing a computer design for a printing control in a flatbed UV printer; and, printing a decoration with UV ink directly on the blank medallion, medal or coin with the flatbed UV printer, wherein the decoration comprises dots of the UV ink of 1.5 to 8 picoliters in size.

2. The medallion, medal or coin of claim 1 wherein the blank medallion, medal or coin is cleaned and degreased prior to placing it in the printer jig.

3. The medallion, medal or coin of claim 1 wherein the blank medallion, medal or coin is not metallized and the decoration further comprises a color background comprising UV ink.

4. The medallion, medal or coin of claim 3 wherein:

(a) the decoration comprises at least one graphic comprising at least one of: (i) computer generated decorations, (ii) designs, and (iii) lettering;

(b) the at least one graphic is disposed within the space on the medallion, medal or coin; and (c) the space is smaller than the blank medallion, medal or coin.

5. The medallion, medal or coin of claim 1 wherein the decoration is sport, event, or customer specific.

6. The medallion, medal or coin of claim 1 wherein the decoration further comprises a primer layer of white UV ink on the blank medallion, medal or coin, wherein the primer layer is provided by the flatbed UV printer, and wherein any further decoration is only printed thereupon after a corresponding portion of the primer layer is cured.

7. The medallion, medal or coin of claim 1 wherein the blank medallion, medal or coin comprises a metal.

8. The medallion, medal or coin of claim 7 wherein the blank medallion, medal, or coin is die-cast.

9. The medallion, medal, or coin of claim 8 wherein the metal is a zinc alloy.

* * * * *